US010633884B2

(12) United States Patent
Robert et al.

(10) Patent No.: US 10,633,884 B2
(45) Date of Patent: Apr. 28, 2020

(54) ENCLOSURE AND EXPANSION STRUCTURE THEREFOR

(71) Applicant: Plano Molding Company, Plano, IL (US)

(72) Inventors: Jay Robert, Star, ID (US); Ryan J. Kleckner, Grafton, WI (US); Matthew Lundy, Yorkville, IL (US)

(73) Assignee: Plano Molding Company, Plano, IL (US)

( * ) Notice: Subject to any disclaimer, the term of this patent is extended or adjusted under 35 U.S.C. 154(b) by 0 days.

(21) Appl. No.: 15/827,383

(22) Filed: Nov. 30, 2017

(65) Prior Publication Data

US 2018/0155952 A1 Jun. 7, 2018

Related U.S. Application Data

(60) Provisional application No. 62/429,227, filed on Dec. 2, 2016.

(51) Int. Cl.

| | |
|---|---|
| ***E04H 15/48*** | (2006.01) |
| ***E04H 15/44*** | (2006.01) |
| ***E04H 15/00*** | (2006.01) |
| ***E04H 15/60*** | (2006.01) |

(52) U.S. Cl.

CPC ..... *E04H 15/44* (2013.01); *E04H 15/001* (2013.01); *E04H 15/48* (2013.01); *E04H 15/60* (2013.01)

(58) Field of Classification Search

CPC ..... E04H 15/48; E04H 15/001; E04H 15/44; E04H 15/36; E04H 15/32; E04H 15/60; E04H 15/405; E04H 15/46; E04H 15/54

USPC ..... 135/135, 137, 147–149, 156, 116, 115, 135/119, 905, 151–155, 159–161, 121, 135/120.3

See application file for complete search history.

(56) References Cited

U.S. PATENT DOCUMENTS

| | | | | |
|---|---|---|---|---|
| 4,026,312 A * | 5/1977 | Beavers | E04H 15/48 | 135/147 |
| 4,285,355 A * | 8/1981 | Lundblade | E04H 15/42 | 135/147 |
| 4,941,499 A * | 7/1990 | Pelsue | E04H 15/42 | 135/125 |

(Continued)

FOREIGN PATENT DOCUMENTS

| | | |
|---|---|---|
| FR | 2809434 A | 11/2001 |
| JP | 50-23125 U1 | 9/2012 |

(Continued)

*Primary Examiner* — Winnie Yip

(74) *Attorney, Agent, or Firm* — Leason Ellis LLP

(57) ABSTRACT

An enclosure that includes a deployable expansion structure for added space. The enclosure comprises a cover that includes a panel, a plurality of wall supports that connect to the panel, with each of the plurality of wall supports having a first end that connects to a portion of panel, an expansion support having a first end and a second end, wherein the first end of the expansion support connects to a portion of the cover, and a hub that connects to a second end of each of the plurality of wall supports and the second end of the expansion support. The expansion support pivots from a first position to a second position with respect to the hub to deploy the expansion structure to form a cavity with additional space.

20 Claims, 9 Drawing Sheets

(56) References Cited

U.S. PATENT DOCUMENTS 5,230,196 A * 7/1993 Zeigler ..... E04B 1/3211 52/108
5,361,794 A * 11/1994 Brady ..... E04H 15/48 135/147
5,632,292 A * 5/1997 Carter ..... E04H 15/50 135/145
5,797,695 A * 8/1998 Prusmack ..... E04H 15/32 135/145
6,021,796 A * 2/2000 Vavra ..... E04H 15/16 135/121
6,223,482 B1 * 5/2001 Zohar ..... E04B 1/3441 135/131
6,520,195 B1 * 2/2003 O'Neal ..... A45B 19/00 135/123
7,311,113 B2 12/2007 Suh
7,320,332 B2 * 1/2008 Reis ..... E04H 15/44 135/115
7,575,010 B2 * 8/2009 Rottmann ..... E04H 15/18 135/120.4
7,766,796 B2 * 8/2010 Pizmony ..... A63B 9/00 482/35
7,896,016 B2 3/2011 Shi
7,958,904 B2 * 6/2011 Lau ..... A01M 31/025 135/147
7,987,864 B1 * 8/2011 Jackson ..... E04H 15/44 135/123
8,186,369 B2 5/2012 Reeb et al.
8,590,554 B2 11/2013 Choi et al.
8,925,565 B2 1/2015 Choi
9,140,030 B2 9/2015 Jin
9,243,423 B2 1/2016 Jin
9,366,054 B2 6/2016 Li
9,976,318 B2 * 5/2018 Lynch ..... E04H 15/40
2006/0144434 A1 * 7/2006 Chen ..... E04H 15/48 135/144
2007/0079860 A1 * 4/2007 Vanderhorst ..... E04H 15/42 135/156
2008/0017232 A1 1/2008 Zeigler
2008/0083443 A1 * 4/2008 Eastman, II ..... E04H 15/001 135/121
2008/0289673 A1 * 11/2008 Roden ..... E04H 15/48 135/97
2008/0307720 A1 * 12/2008 Howe ..... E04B 1/3211 52/81.3
2012/0055525 A1 * 3/2012 Choi ..... E04H 15/48 135/147
2013/0008478 A1 * 1/2013 Prieto Estebanez .... E04H 15/48 135/147
2015/0250162 A1 * 9/2015 Wyant ..... E04H 15/001 135/147
2016/0208513 A1 * 7/2016 Ways ..... E04H 15/425
2018/0066446 A1 * 3/2018 Nolz ..... E04H 15/48

FOREIGN PATENT DOCUMENTS

KR 90-9210 Y1 10/1990
RU 2238383 C1 10/2004

* cited by examiner

ENCLOSURE AND EXPANSION STRUCTURE THEREFOR

CROSS REFERENCE TO PRIOR APPLICATION

This application claims priority to and the benefit thereof from U.S. Provisional Patent Application No. 62/429,227, filed Dec. 2, 2016, titled "POP OUT EXPANSION TO HUNTING ENCLOSURES, ICE FISHING SHELTERS AND ALL HUB STYLE CAMPING ENCLOSURES," the entirety of which is hereby incorporated herein by reference.

FIELD OF THE DISCLOSURE

The disclosure relates generally to an expandable enclosure and, more particularly an expandable enclosure with an expansion structure. The disclosure also relates to an expansion structure for an expandable enclosure that includes an expansion frame.

BACKGROUND OF THE DISCLOSURE

Hub shelters are very popular in the hunting industry as well as the ice fishing industry. As of this writing, hub shelters were starting to be used in the camping industry for camping tents.

Hub shelters typically include a hub assembly that has two or more poles attached to a hub to support a tent structure. Such hub shelters generally use a pressure fit hub assembly to support the structure. The shelter structure may be bowed out at the middle of each side panel due to this hub assembly. Shelters that have hub assemblies tend to suffer from lack of usable space compared to the footprint required by the shelter. Thus, a significant drawback of hub shelters is the lack of storage space relative to the footprint of the shelter.

Additionally, shelters with hub assemblies tend to look very similar, since the hub assemblies require certain geometries for the walls, roof, openings, etc. of the shelters. This can be problematic in the case where the shelter is a hub shelter blind, since the geometries required by the hub assembly can limit design and frame specifications, as well as variations thereof, thereby limiting design options for the overall look of hub shelter to only a few similar designs.

An unfulfilled need exists for an expandable enclosure and an expansion structure that maximizes usable space while allowing for greater flexibility in design and function of the enclosure.

SUMMARY OF THE DISCLOSURE

According to the principles of the disclosure, an expandable enclosure is provided that may have maximal space for a given footprint of the enclosure. The enclosure may be constructed to have a unique design, unique appearance, or previously unavailable functionality. The enclosure includes an expansion structure that provides additional useable space. The expansion structure includes an expansion frame that creates a storage space, an access view, an opening (e.g., a window, a door, or the like), or the like.

The enclosure with expansion structure allows for novel geometries for storage spaces, access views, and/or openings. The novel geometries may include angles that were previously not possible for the overall expansion structure design. Portions of the expansion structure may include an opening such as an access opening, a window, a door, a ventilation opening, or the like, that may not otherwise be possible.

According to an aspect of the disclosure, an enclosure is provided that includes an expansion structure for added space. The enclosure comprises: a cover that includes a panel; a plurality of wall supports that connect to the panel, with each of the plurality of wall supports having a first end that connects to a portion of panel; an expansion support having a first end and a second end, wherein the first end of the expansion support connects to a portion of the cover; and a hub that connects to a second end of each of the plurality of wall supports and the second end of the expansion support, wherein the expansion support pivots from a first position to a second position with respect to the hub, thereby deploying the expansion structure to form a cavity with additional space. The first position may be a substantially collapsed position and the second position may be a substantially extended position. The plurality of wall supports may comprise four wall supports. The panel may comprise a wall or a roof of the enclosure.

The hub may comprise a main hub and a subhub that are separable from each other. The hub may comprise a bracket.

The expansion structure may comprise an expansion frame that includes the expansion support.

The enclosure may comprise a fastener that connects to the second end of at least one of the plurality of wall supports, wherein the fastener allows said at least one of the plurality of wall supports to pivot with respect to the hub.

The enclosure may comprise an adjuster that varies an angle between the hub and the second end of at least one of the plurality of wall supports.

The enclosure may comprise a fastener that connects to the second end of expansion support, wherein the fastener allows the expansion support to pivot with respect to the hub.

The enclosure may comprise an adjuster that varies an angle between the hub and the second end of at least one of the plurality of wall supports.

The enclosure may comprise a hub assembly. The enclosure may comprise a hunting blind, an ice shelter, a tent, or the like.

The expansion structure comprises an expansion frame. The expansion structure may comprise a cover. The cover may be formed as a single piece with the cover for the expandable enclosure, or attached to the cover for the expandable enclosure. The cover may include one or more layers of material. The one or more layers may include an inner layer and an outer layer. The material may include a fabric, denier, canvas, nylon, plastic, metal, hemp, cotton, or the like.

The expansion structure provides for an ability to expand storage space, an opening (e.g., a window, a door, or the like), a roof height, a wall depth, or the like. The expansion structure provides for an ability to change a shape of a wall, roof, opening, or the like in an enclosure. For instance, the expansion structure may be deployed to change a shape of a panel that forms a wall or a roof of the enclosure.

The expansion structure may be configured to automatically deploy with (or without) deployment of the expansion system, or manually deploy under application of a positive or negative force. The expansion structure may automatically deploy with deployment of an enclosure that includes the expansion structure. Alternatively, the expansion structure may be manually deployed by a user applying a force (positive or negative) to a portion of the expansion structure, such as, for example a portion of the expansion frame or cover. The expansion structure may include multiple options for deployment to create usable space within (and/or external to) the enclosure.

The expansion structure may be retracted (or collapsed) into the enclosure, such as, for example, when not in use.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

Figure 1:
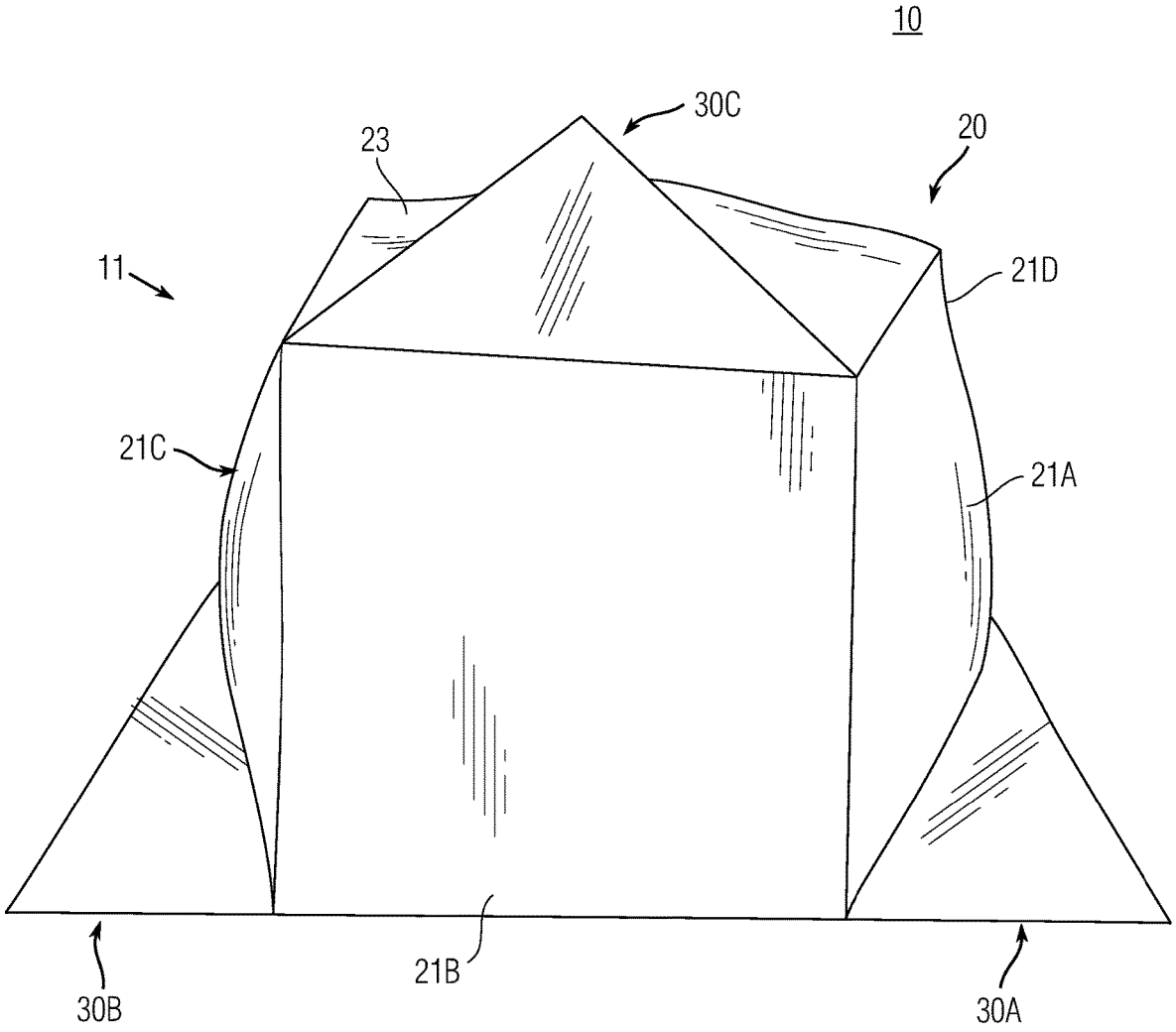
FIG. 1 shows an example of an expandable enclosure constructed according to principles of the disclosure.

The present disclosure is further described in the detailed description and drawings that follows.

DETAILED DESCRIPTION OF THE DISCLOSURE

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

FIG. 1 shows an example of an expandable enclosure 10 that includes an enclosure 20 and an expansion structure 30. The expansion structure 30 may be attached to or integrally formed with the expandable enclosure 20.

The enclosure 20 includes one or more walls 21 that may be formed by one or more panels, respectively. As seen, the enclosure 20 may include a plurality of walls (or panels) 21, including walls 21A, 21B, 21C, and 21D. In FIG. 1, the wall 21D is not shown, as it is located on the non-visible side of the enclosure 20. The enclosure 20 may include a roof 23 that may be formed by a panel. The enclosure 20 may include a floor (not shown).

The expansion structure 30 includes one or more expansion units 30A, 30B, 30C. The expansion structure 30 may be located anywhere with respect to the enclosure 20. For instance, the expansion structure 30 may be located on one or more of the enclosure walls 21 and/or the roof 23.

FIG. 1 shows an embodiment of the expandable enclosure 10 that includes a pair of expansion units 30A and 30B attached to or integrally formed with the walls 21A and 21C, respectively, of the enclosure 20. As seen, the expansion units 30A and 30B may be located on opposite sides of the enclosure 20. The expansion unit 30C may be located on the roof 23. The expansion structure 30 may have additional expansion units (e.g., shown in FIG. 3), which may be located anywhere with respect to the enclosure 20.

The expansion units 30A, 30B, and/or 30C may be deployed to provide additional space. For instance, the expansion units 30A and/or 30B may be deployed to provide additional space to store articles such as, for example, footwear (e.g., boots), backpacks, or any other item an occupant user may want to store outside of the inner space formed by the walls 21 of the enclosure 20. The expansion units 30A and/or 30B may be deployed to provide further sleeping space, for example, to allow an occupant to place her/his feet and/or head in the space(s) formed by the expansion units 30A and/or 30B when deployed.

The expansion unit 30C may be deployed to provide additional space in the roof 23 of the enclosure 20. The additional space may be used as added headroom or to hang items (such as, e.g., a lantern, a speaker, a light, or the like) overhead in the enclosure 20.

The expandable enclosure 10 includes an enclosure frame (e.g., shown in FIG. 12) and an expansion frame 40. The enclosure 20 includes the enclosure frame, which may comprise the expansion frame 40. The enclosure frame may be deployed to erect and support the walls 21 and roof 23 of the enclosure 20 in a deployed configuration (shown in FIG. 1).

The expandable enclosure 10 may comprise one or more expansion frames 40 (shown in FIGS. 6-9). In the example shown in FIG. 1, the expandable enclosure 10 comprises three expansion units 30 (30A, 30B, 30C), each of which comprises an expansion frame 40. Each expansion frame 40 may be attached to or integrally formed with the enclosure frame and/or a wall 21 and/or roof 23 of the enclosure 20.

The expandable enclosure 10 may comprise a cover 11 that may include one or more layers of material. The cover 11 may be formed as a single structure that attaches to, or is integrally formed with the enclosure frame, which may include one or more expansion frames. The cover 11 may be formed as a plurality of structures that may be attached to each other by any appropriate attachment mechanism, such as, for example, a zipper, stitching, buttons, hook-and-loop (e.g., Velcro) fasteners, rope, wire, rivets, pins, bolts, staples, or the like.

In the case of two or more layers, the inner layer of the cover 11 (i.e., side of the cover 11 facing inner space formed by the expandable enclosure 10) may be made of the same or a different material than the outer layer of the cover 11. The cover 11 may include one or more layers between the inner and outer layers. The cover 11 may include an insulating material. The cover 11 may include the cover described in U.S. patent application Ser. No. 15/686,253, filed Aug. 25, 2017, titled "Outdoor Enclosure with Natural Visual Characteristics," the entirety of which is hereby incorporated herein by reference.

Figure 2:
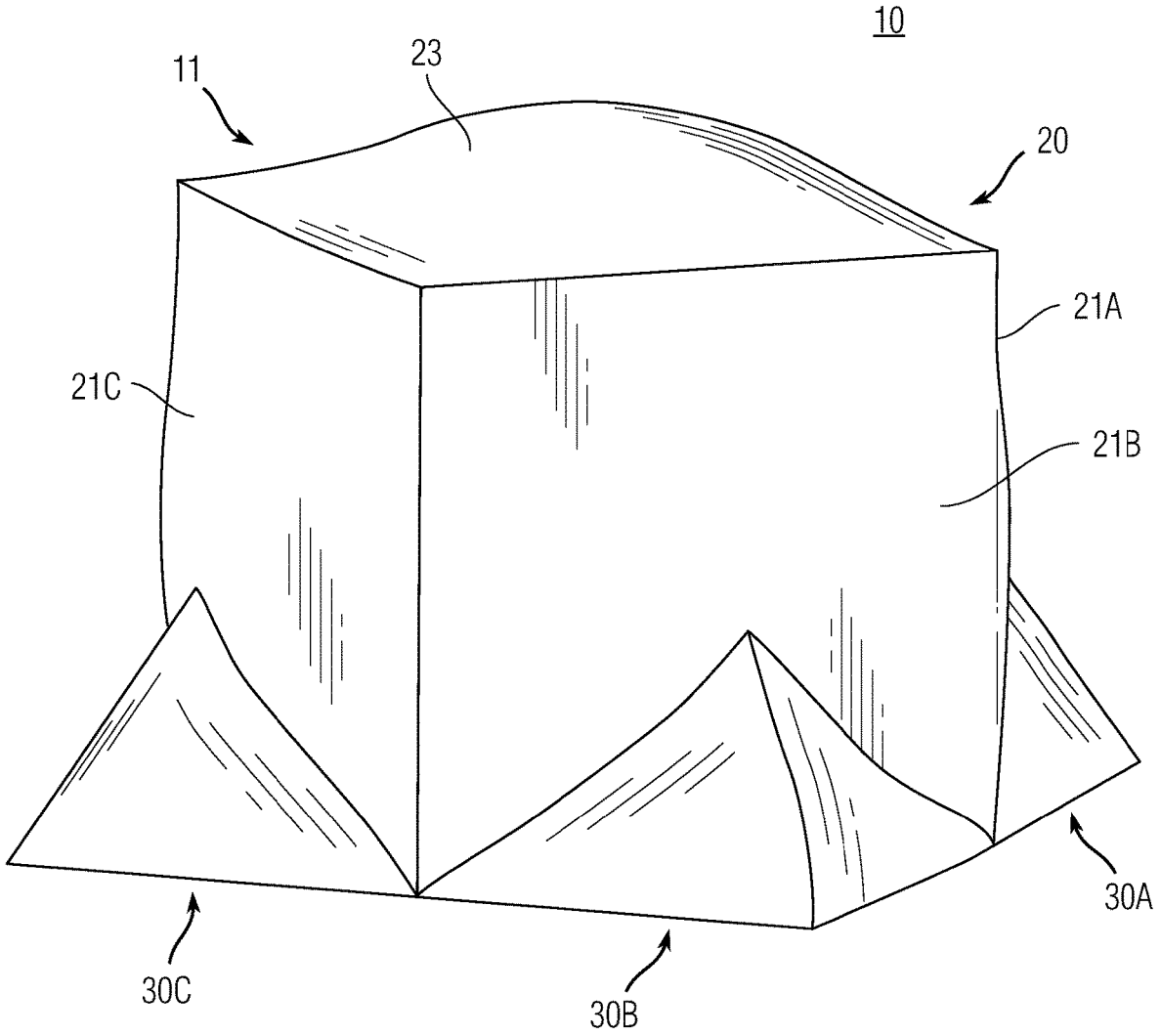
FIG. 2 shows another example of an expandable enclosure constructed according to principles of the disclosure.

FIG. 2 shows another example of an expandable enclosure 10 that includes an enclosure 20 and expansion structure 30. In this example, the expansion structure 30 includes expansion units 30A, 30B, and 30C, which may be located on three or more of the walls 21 that form the enclosure 20, including walls 21A, 21B, and 21C. The expandable enclosure 10 may include an expansion structure 30 on fewer than the three walls 21A, 21B, and 21C. The enclosure 20 may include a fourth wall 21D, which may also be attached to or include an expansion unit 30D.

Figure 3:
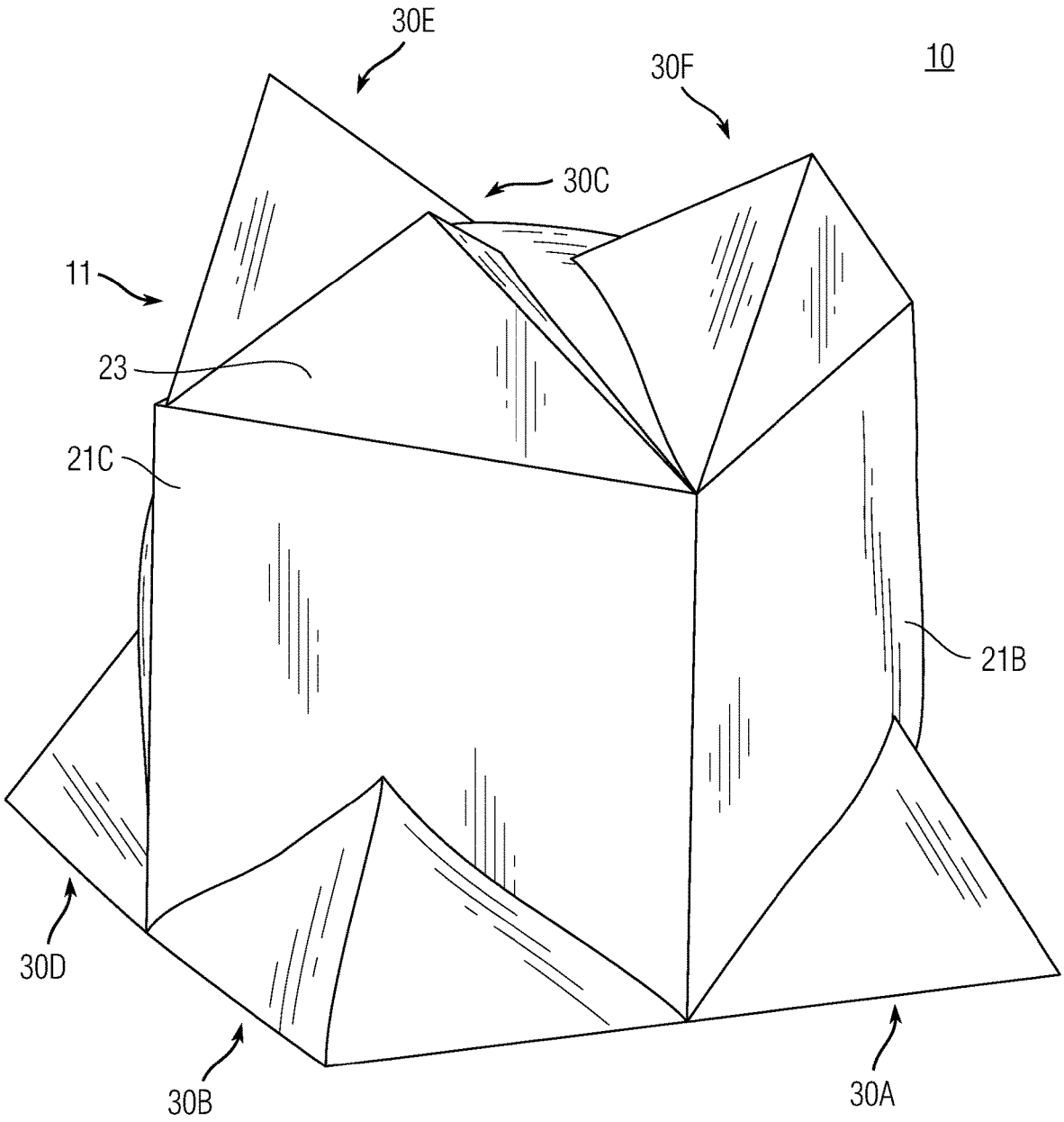
FIG. 3 shows a further example of an expandable enclosure constructed according to principles of the disclosure.

FIG. 3 shows yet another example of an expandable enclosure 10 that includes an enclosure 20 and expansion structure 30. Similar to the expandable enclosure 10 in FIG. 2, this embodiment of the expandable enclosure 10 includes the expansion structure 30 on three or more of the enclosure walls 21. This embodiment of the expandable enclosure 10 also includes three expansion units 30 (30C, 30E, 30F) attached to or integrally formed with the roof 23 of the enclosure 20.

Figure 4:
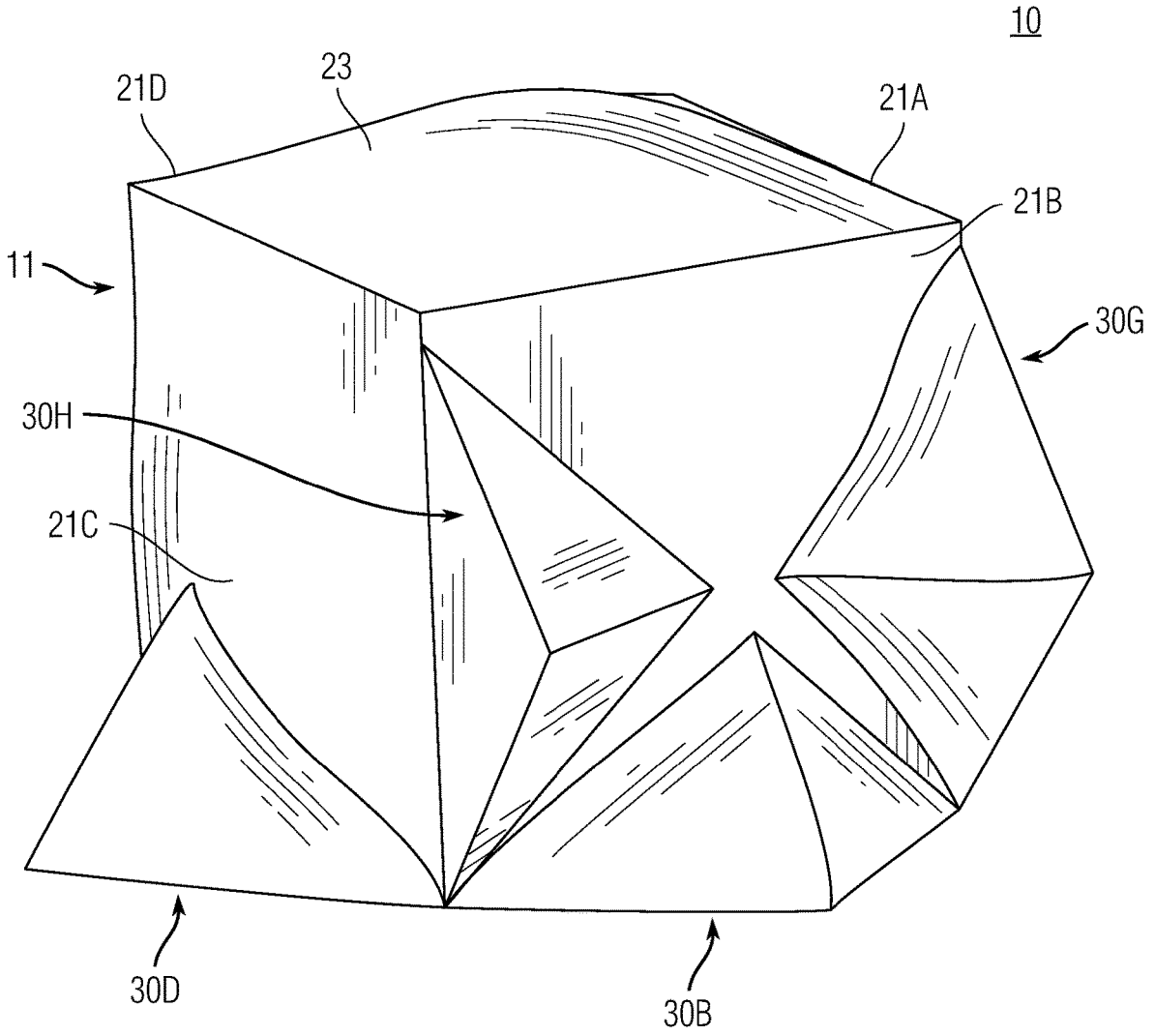
FIG. 4 shows a still further example of an expandable enclosure constructed according to principles of the disclosure.

FIG. 4 shows a still further example of the expandable enclosure 10 constructed according to principles of the disclosure. Similar to the expandable enclosure 10 in FIG. 2, this embodiment of the expandable enclosure 10 includes the expansion structure 30 (30A, 30B, 30C) on three or more of the enclosure walls 21 (21A, 21B, 21C) of the enclosure 20. The expandable enclosure 10 may include an expansion structure 30 on a fourth wall 21D of the enclosure 20. Due to the perspective view of the expandable enclosure 10, the enclosure walls 21A and 21D are not visible.

As seen in FIG. 4, the expandable enclosure 10 may include one or more (e.g., two) additional expansion structures 30 (30G, 30H) on one of the walls 21 (e.g., wall 21B), which may be in addition to the expansion unit 30B. The additional expansion units 30G and/or 30H may be located anywhere on the wall 21B. For instance, the expansion unit 30B may be located proximate to the lower portion of the wall 21B and configured to be deployed to provide additional floor space. Whereas the expansion units 30G and/or 3H may be located proximate a right and/or left portion of the wall 21B to provide additional horizontal space near the left- and/or right-mid portions of the wall 21B.

As seen in FIGS. 1-4, the expansion structure 30 may be integrally formed with the walls 21 and/or roof 23 of the enclosure 20, and designed to extend out from the enclosure 20 to provide additional space when deployed. The expansion structure 30 may include a shape such as, for example, a triangle, a pyramid, a rectangle, a box, a square, a circle, sphere, a semi-sphere, an oval, or the like. The expansion structure 30 may be configured to be deployed by application of a positive or a negative force.

The positive force may include, for example, supplying pressurized gas (e.g., air) into the cavity formed by the expansion structure 30, pushing (e.g., by hand, foot, a tool, a spring mechanism, a pressurized actuator (e.g., pressurized air or nitrogen gas piston-rod assembly), or the like) the expansion structure 30 outward and away from the enclosure 20, pushing a portion of an expansion frame 40 (such as, e.g., an expansion support 22, described below), or any sort of force that may be applied to cause the outer walls of the expansion structure 30 to expand or deploy (e.g., pop-out).

A negative force may include, for example, grasping an outer portion (e.g., a portion of the cover 11) of the expansion structure 30 by hand, or the like, and pulling at least a portion of the expansion structure 30 outward and away from the enclosure 20.

Figure 5:
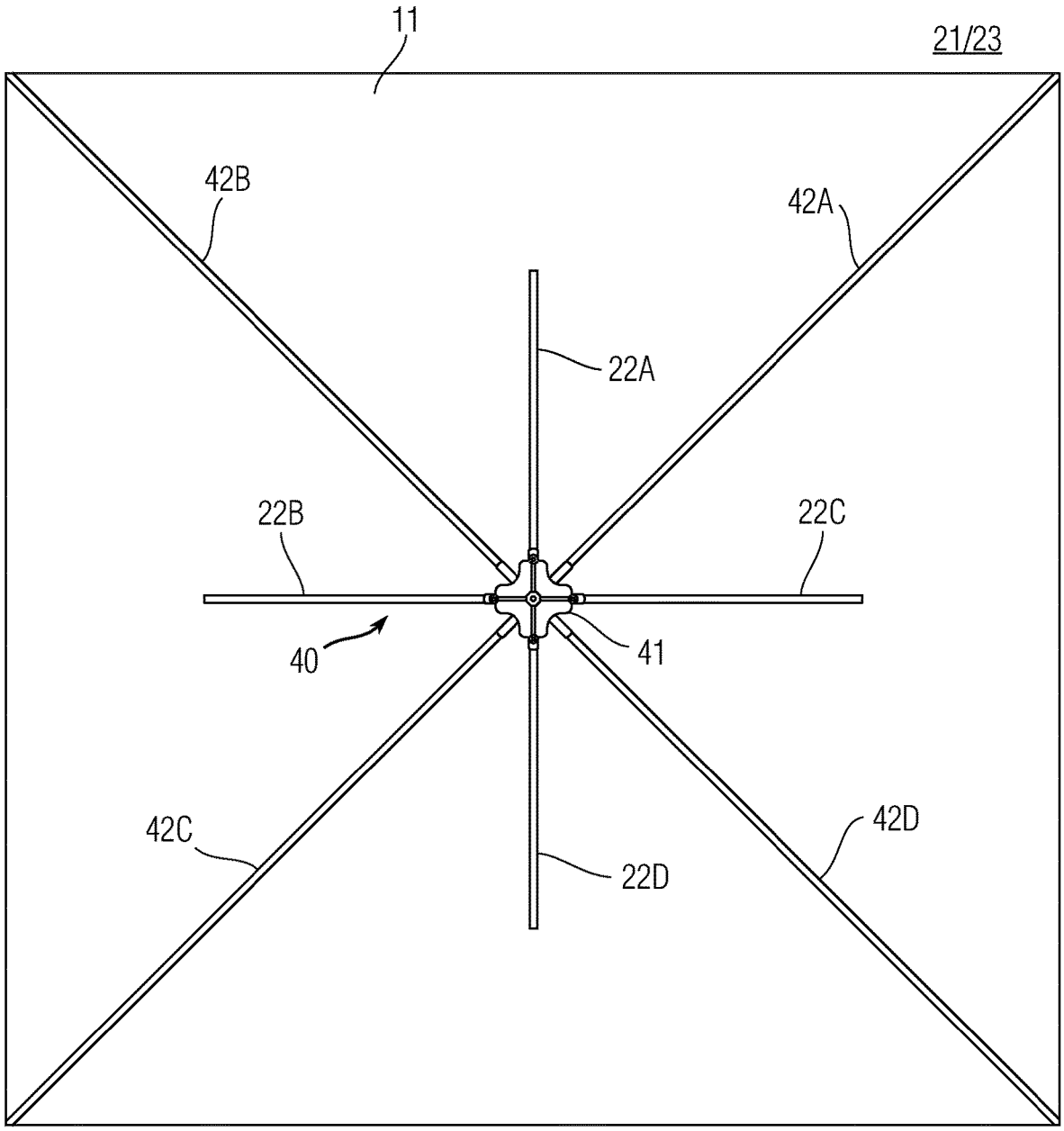
FIG. 5 shows an example of an enclosure wall with an expansion structure having an expansion frame, constructed according to principles of the disclosure.

FIG. 5 shows an example of a wall 21 of an enclosure 20 with an expansion structure having an expansion frame 40, constructed according to principles of the disclosure. The wall 21 may be included in any of the expandable enclosures 10 of FIGS. 1-4, and, more particularly, in any of the enclosures 20 in FIGS. 1-4. The roof 23 may be configured substantially the same as the wall 21.

Referring to FIG. 5, the wall 21 may include a portion of the cover 11 and the expansion frame 40, wherein the portion of the cover 11 may be the entire cover 11, or a fraction thereof. The expansion frame 40 includes a hub 41, one or more expansion supports 22, and one or more wall supports 42. The one or more expansion supports 22 (and/or wall supports 42) may be attached to, or integrally formed with the enclosure frame that supports a wall 21 (or roof 23) in the enclosure 20. The hub 41 may include a bracket with a channel for each expansion support 22 and/or wall support 42 (e.g., shown in FIG. 6-7 or 10-11). Where the hub 41 comprises a main hub 44 and a subhub 49 that are separable from each other, the main hub 44 and the subhub 49 may each comprise a bracket with a channel for each expansion support 22 and/or wall support 42.

Figure 12:
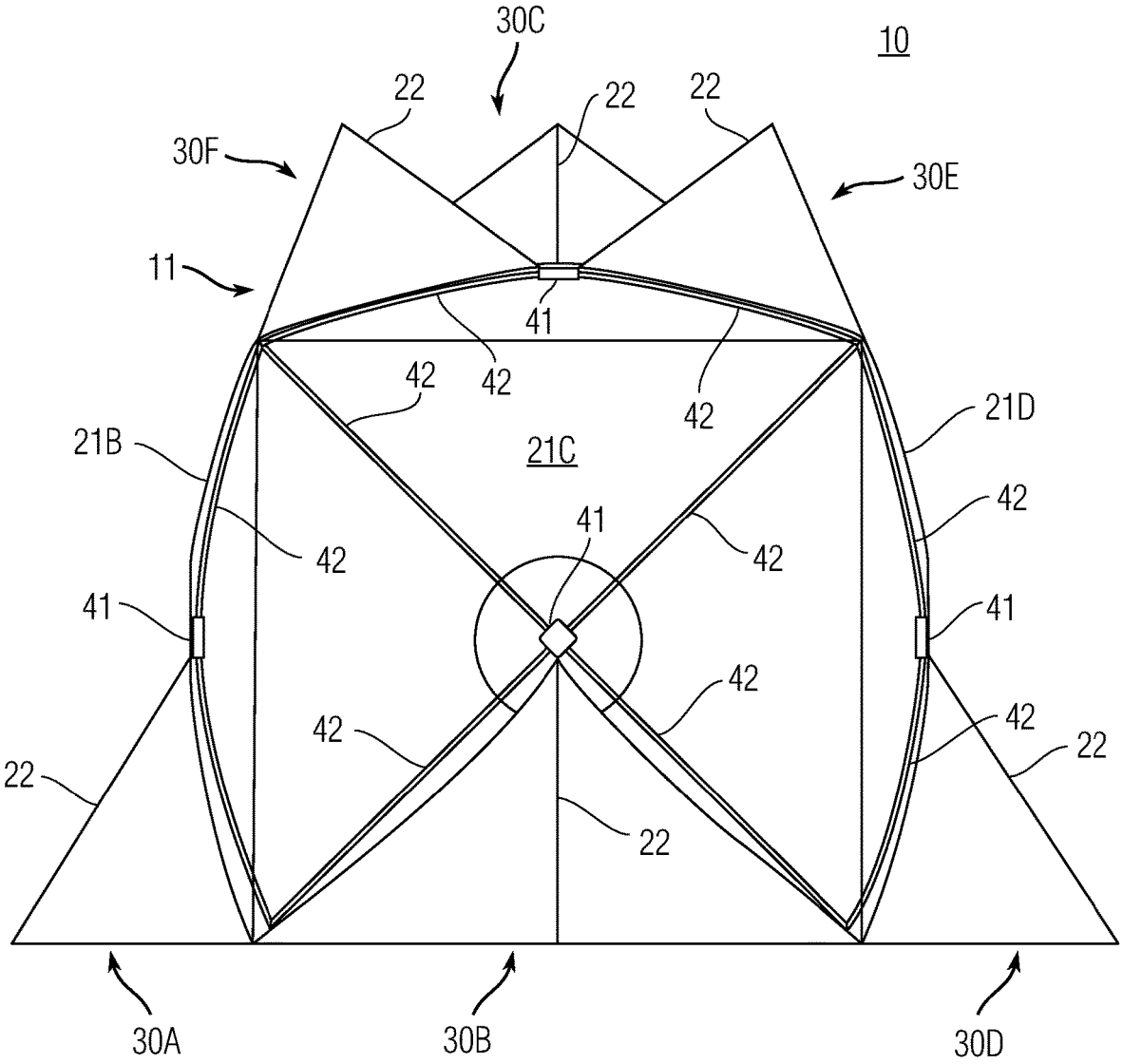
FIG. 12 shows a cut-away view of the expandable enclosure in FIG. 3.

According to one non-limiting embodiment, the expansion frame 40 may be used to support an entire wall 21 (or roof 23) by means of the wall supports 42 (as shown, e.g., in FIG. 12). Alternatively, the expansion frame 40 may be attached to a conventional hub assembly (not shown) by, for example, attaching the expansion supports 22 (or wall supports 42) and/or hub 41 to the hub assembly (not shown). Regarding the latter, the expansion support 22 (or wall support 42) and/or hub 41 may be attached to any portion of the hub assembly (not shown), such as, for example, one or more of the poles (not shown), or one or more hubs (not shown) of the hub assembly. If, for example, the enclosure structure 30 is to be located closer to a corner of a wall 21 and attached to a hub assembly (not shown), the expansion support(s) 22 (or wall support(s) 42) may be attached to a part of a hub assembly pole (not shown) that is proximate to the corner of the wall 21, such as, for example, the diagonal poles (not shown) of the hub assembly.

The enclosure frame may include, for example, an expansion frame 40 for each wall 21 and/or roof 23 of the enclosure 20 (e.g., shown in FIG. 12). The expansion frame 40 may be attached to one or more portions of the cover 11 to form the wall 21 or roof 23. In the case where the expansion frame 40 has four wall supports 42, one end of each of the supports 42 may be attached to a different edge and/or corner of the wall 21 or roof 23, with the other end attached to the hub 41.

The expansion support 22 may include, for example, a pole, a rod, a bar, or the like, which may be made of plastic, carbon fiber, metal, fiberglass, or the like. The expansion support 22 may be attachable to the cover 11 and/or any portion of the enclosure frame. The wall support 42 may be constructed the same as, or similar to the expansion support 22. The wall support 42 may have a length equal to, or greater than the length of the expansion support 22, so as to allow the expansion support(s) 22 to be pushed or popped out (or pulled, depending on whether the user is inside or outside the expandable enclosure 10) past the plane of the wall support(s) 42 when the wall support 42 is in the deployed configuration (shown in FIG. 5), thereby deploying the expansion structure 30 to provide additional space.

Figure 6:
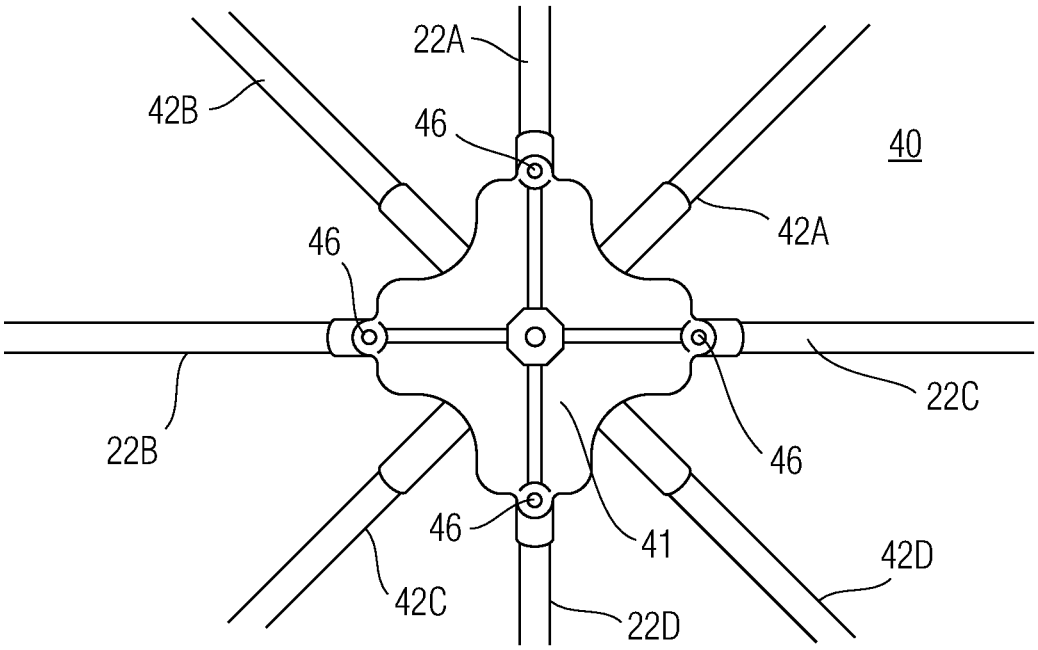
FIG. 6 shows a first view of an example of an expansion frame that may be included in the expandable enclosure of FIGS. 1-4.

FIG. 6 shows a first view of an example of an expansion frame 40 that may be included in the expandable enclosure 10 (e.g., shown in FIGS. 1-4). The view shown in FIG. 6 may be the view of the expansion frame 40, for example, from within the enclosure 20. As seen, the expansion frame may include a plurality of expansion supports 22 (e.g., four, including 22A, 22B, 22C, 22D), a plurality of wall supports 42 (e.g., four, including 42A, 42B, 42C, 42D), and a hub 41. The hub 41 may include one or more adjusters 46. The expansion supports 22 and wall supports 42 may nest in the hub 41, as seen in FIGS. 6-11.

Figure 7:
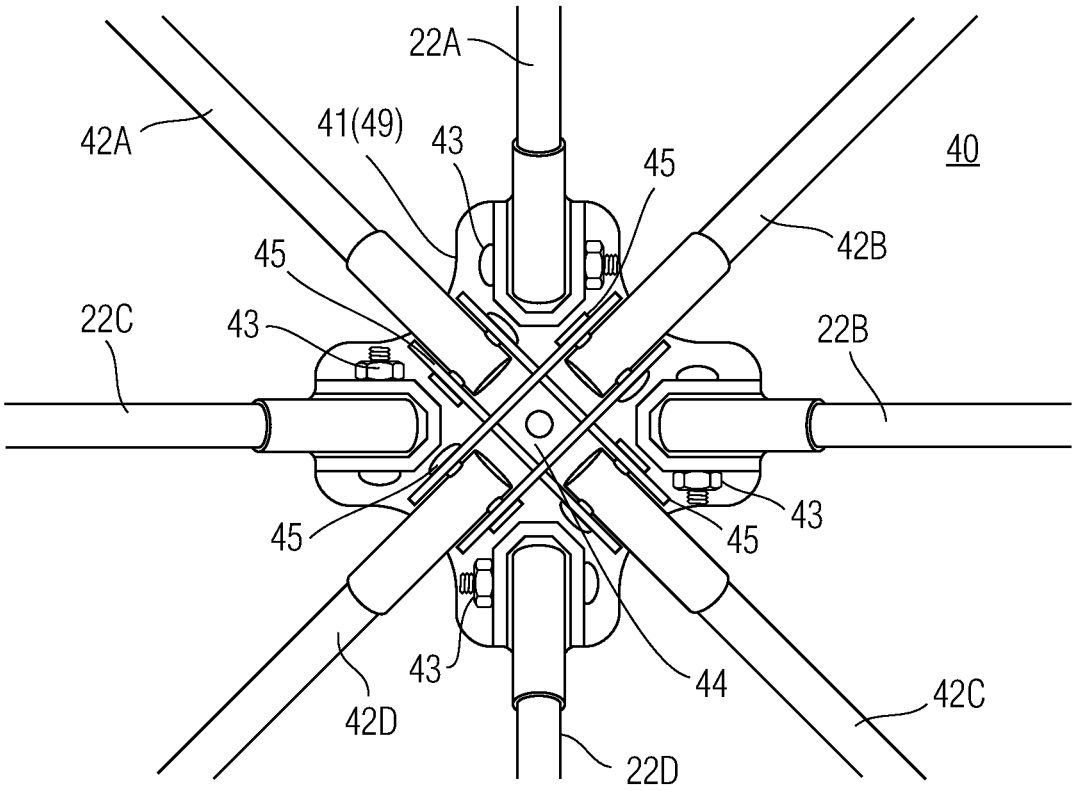
FIG. 7 shows a second view (opposite to the first view) of the expansion frame in FIG. 6.

FIG. 7 shows a second view of the expansion frame 40, wherein the second view is a view of the opposite side of the expansion frame 40 shown in FIG. 6. Each expansion support 22 may be attached at one end to the hub 41 by a fastener 43, which is configured to allow the expansion support 22 to pivot or adjust angularly with respect to the hub 41. The fastener 42 may include, for example, a pivot, a screw (e.g., a pole set screw), a rivet, a pin, a bolt, or any other mechanism that may attach the expansion support 22 to the hub 41. The fastener 43 may further include a spring mechanism (not shown), a memory steel mechanism (not shown), or any other mechanism (not shown) that can drive the expansion support 22 to automatically deploy (and/or retract) with respect to the hub 41.

As seen in FIG. 7, the hub 41 may include a main hub 44 and a subhub 49. The subhub 49 may be attached to the main hub 44 to form the hub 41, or it may be integrally formed with the main hub 44 to form the hub 41. Each wall support 42 may be attached at one end to the main hub 44 (or hub 41) by a fastener 45, which is configured to allow the wall support 42 to pivot or adjust angularly with respect to the main hub 44 (or hub 41). The fastener 45 may include a spring mechanism (not shown), a memory steel mechanism (not shown), or any other mechanism (not shown) that can drive the wall support 42 to automatically deploy (and/or retract) with respect to the main hub 44. The fastener 45 may be the same as or differ from the fastener 43.

The main hub 44 and subhub 49 may be separable from each other, or formed as one part. A separable hub 41 may allow for replacement or interchangeable use of, for example, a main hub 44 configured to support four wall supports 42 with a main hub 44 that is configured to support fewer (or more) than four wall supports 42, without replacing the subhub 49.

Referring to FIGS. 6 and 7, the adjuster 46 may be adjustably attached to the hub 41. An adjuster 46 may be provided for each expansion support 22. An adjuster 46 may be provided for each wall support 42. The adjuster 46 may be adjustably attached to the hub 41 such that the angle between the expansion support 22 and hub 41 may be adjusted by manipulating the adjuster 46. The adjuster 46 may include, for example, a screw, a bolt, a pin, or the like, that may be installed in an opening (not shown) in the hub 41.

The adjuster 46 may be designed such that turning the adjuster 46 causes the adjuster 46 to travel along its longitudinal axis with respect to the hub 41 and force the corresponding expansion support 22 (or wall support 42) to pivot away from the hub 41, or allow the expansion support 22 (or wall support 42) to be pivoted toward the hub 41, with the expansion support 22 pivoting about the fastener 43 (or the wall support 42 pivoting about the fastener 45).

It is noted that the wall supports 42 may be used in the expansion frame 40, in which case the expansion supports 22 would be used to support the wall(s) 21 and/or roof 23 of the enclosure 20. However, in this instance, the length of the wall supports 42 would need to be the same or shorter than the length of the expansion supports 22, so as to allow the wall supports 42 to move and extend past the enclosure wall 21 (or roof 23) without obstruction.

The example of the expansion frame 40 shown in FIGS. 6 and 7 comprises four expansion supports 22 and four wall supports 42. The expansion frame 40 may include fewer (or more) than four expansion supports 22 and/or fewer (or more) than four wall supports 42.

Figure 8:
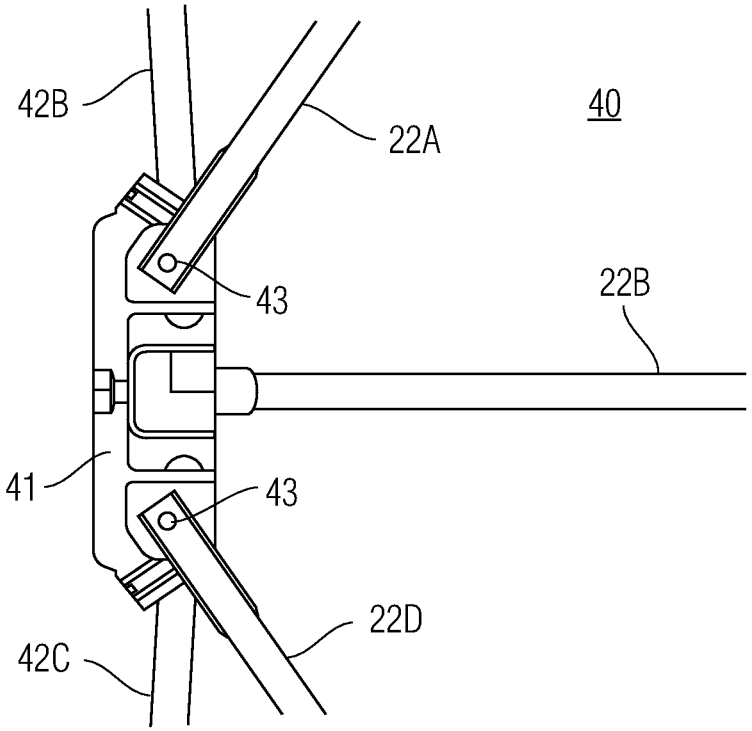
FIG. 8 shows a side view of the expansion frame in FIGS. 6-7.
Figure 9:
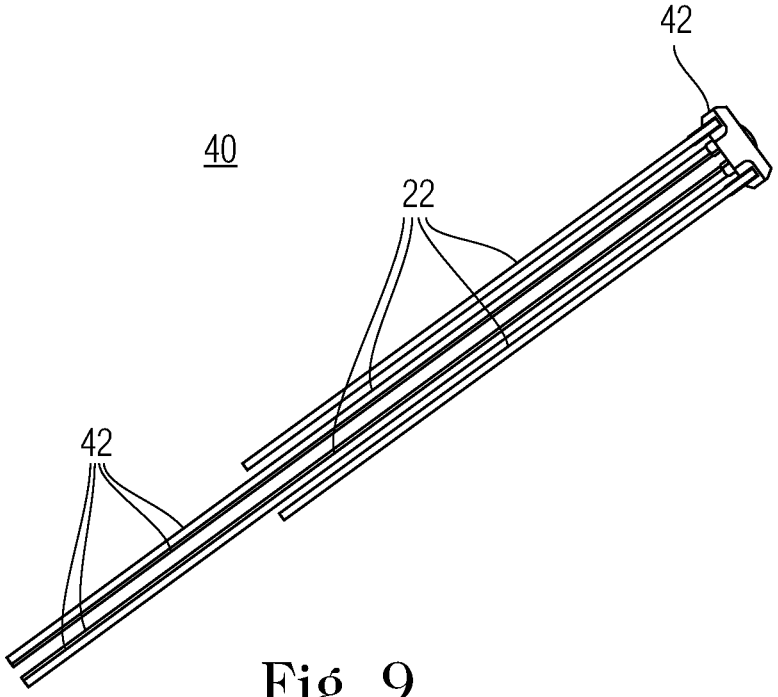
FIG. 9 shows a view of the expansion frame of FIGS. 6-7 in a collapsed configuration.

FIG. 8 shows a side cut-away view of the expansion frame 40, shown in FIGS. 6-7; and, FIG. 9 shows a view of the expansion frame 40 in a collapsed configuration. As seen in FIGS. 8 and 9, the expansion supports 22 and wall supports 42 may be collapsed to a collapsed configuration. In the collapsed configuration, the expansion supports 22 and wall supports 42 are parallel to each other with the hub 41 on the end.

Figure 10:
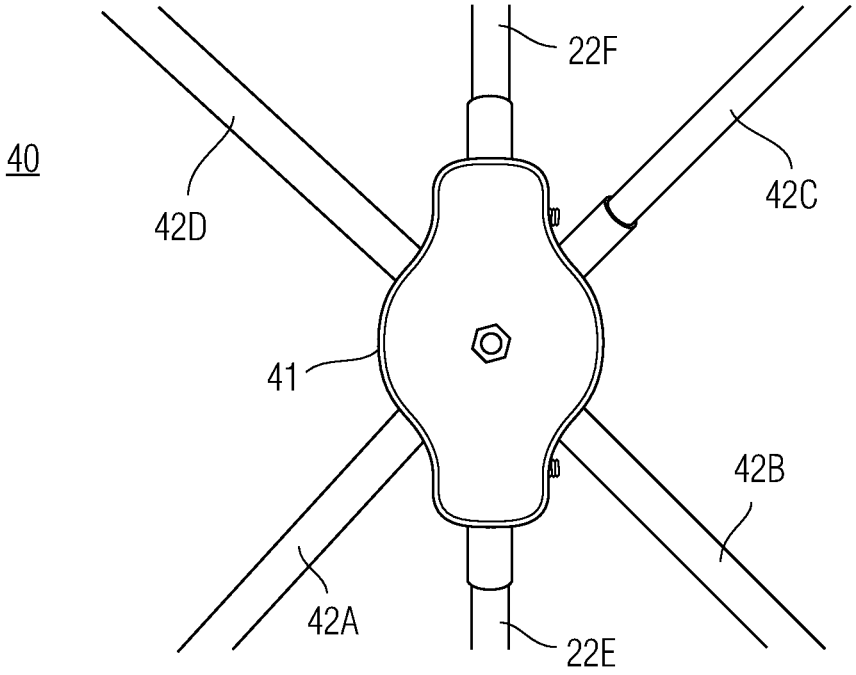
FIG. 10 shows a first view of another example of an expansion frame that may be included in the expandable enclosure of FIGS. 1-4.
Figure 11:
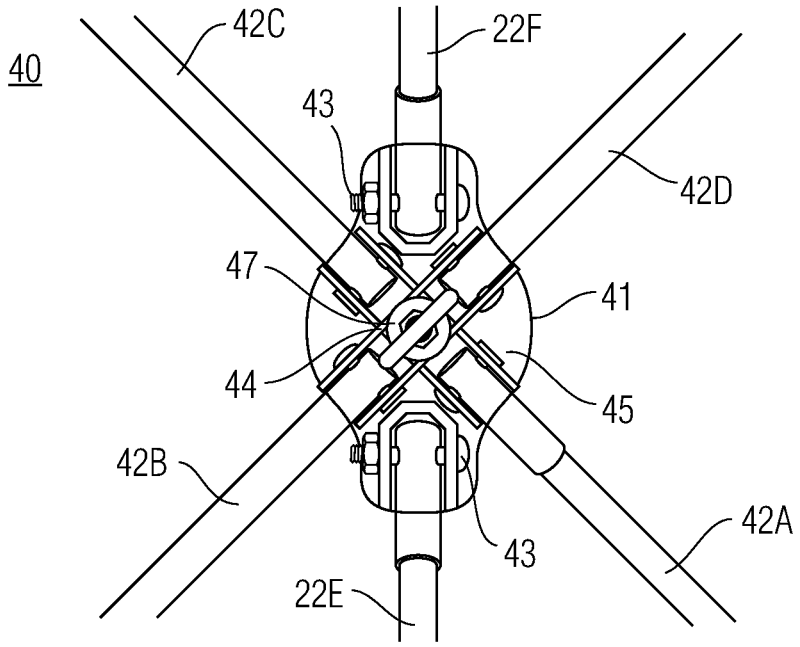
FIG. 11 shows a second view (opposite to the first view) of the expansion frame in FIG. 10.

FIGS. 10 and 11 show another example of an expansion frame 40, constructed according to the principles of the disclosure. FIG. 10 shows a first view of the expansion frame 40, which may be visible from within an expandable enclosure 10 (e.g., shown in FIG. 12). As seen in FIG. 10, the expansion frame 40 may comprise four wall supports 42 (e.g., 42A, 42B, 42C, 42D) and two expansion supports 22 (e.g., 22E, 22F). In this example, the hub 41 may be configured to adjustably support the ends of only two expansion supports 22E, 22F, and four wall supports 42A, 42B, 42C, 42D, each of which may be attached to the hub 41 by means of a fastener 43 or 45. The main hub 44 may be attached to or integrally formed with the subhub 49 to form the hub 41. The main hub 44 may be configured to adjustably support the ends of the four wall supports 42A, 42B, 42C, 42D. The subhub 49 may be configured to adjustably support the ends of the two expansion supports 22E, 22F. Alternatively, the main hub 44 may be configured to support the ends of the two expansion supports 22E, 22F, in which case the subhub 49 would adjustably support the ends of the four wall supports 42A, 42B, 42C, 42D. Alternatively, the expansion frame 40 may comprise two wall supports 42 and four expansion supports 22 (not shown).

As seen in FIG. 11, the hub 41 may include a pull 47. The pull 47 may be attached to, or integrally formed with the hub 41 and configured to be grasped by, for example, a user's finger or hand. The pull 47 may include, for example, an eye or opening through which the user may insert his/her index finger, so as to grasp and pull the hub 41 toward the user, thereby collapsing the expansion frame 40.

FIG. 12 shows a cut-away view of the expandable enclosure 10 in FIG. 3. As seen in FIG. 12, the enclosure frame may include five expansion frames 40, each of which may form/support a wall 21A, 21B, 21C, 21D and the roof 23. The expansion frames 40 that are attached to the walls 21B, 21C, 21D may each include wall supports 42 and one or more expansion supports 22. The expansion support 22 of the expansion frame 40 in the wall 21B may be extended to deploy the expansion unit 30A, thereby forming a triangular shape. Expansion supports 22 in the expansion frames 40 in the walls 21C and 21D may be similarly extended to deploy the expansion units 30B and 30D, respectively.

Referring to the roof 23 in FIG. 12, the expansion frame 40 may include four wall supports 42 and three expansion supports 22. As seen, the three expansion supports 22 may be extended to form the expansion units 30C, 30E, 30F.

Referring to FIG. 12, a user may deploy the expandable enclosure 10 from a collapsed configuration (not shown) to the deployed configuration (shown in FIG. 12) as follows. For example, the user may first push or pull the hub 41 for the wall 21C to fully extend the wall supports 42 and lock all four wall supports 42 and hub 41 in the extended configuration (shown in FIG. 12), thereby erecting the wall 21C. If desired, the user may deploy the expansion unit 30B by applying a positive or negative force to the expansion support 42 or a portion of the cover 11 attached to the expansion support 22 to extend the expansion support 22 outward.

The hub 41 may include a lock/release mechanism (not shown) that may secure the wall supports 42 (and/or expansion supports 22) in the extended configuration until a force above a predetermined threshold (e.g., 5-10 psi, 10-15 psi, 15-20 psi, 20-30 psi, etc.) is applied to the wall supports 42 to collapse the wall supports 42 into the collapsed configuration. The lock/release mechanism may include, for example, a tongue-and-groove (not shown), a notch and protrusion (not shown), a spring (not shown), or any other mechanism that may hold the wall support 42 in a predetermined position with respect to the hub 41. The hub 41 may include the same (or different) lock/release mechanism (not shown) to hold the expansion supports 22 in a predetermined position with respect to the hub 41. The lock/release mechanism may include multiple locking positions (not shown), so that the expansion support 22 may be extended and locked (e.g., in steps) in any one of a plurality of positions, ranging from the collapsed configuration (shown in FIG. 9) to a fully extended position (not shown).

The process described for wall 21C may be repeated for each of the other walls 21A, 21B, 21D of the expandable enclosure 10. Where the expansion frame comprises more than one expansion support 22 (such as, e.g., the roof 23 in FIG. 12), the user may selectively deploy one or more expansion units 30 (e.g., 30C, 30E, 30F) by selectively repeating the process described above with respect to the expansion unit 30B.

When the wall 21 (or roof 23) is pulled (or forced) into the open position, the diagonal wall supports 42 may push firmly against the large areas with the cover 11, thereby creating a wall 21 or a roof 23. The arching of the diagonal wall supports 42 may keep them open by creating back pressure—a lock/release mechanism (not shown) may be optionally included. The expansion supports 22 may automatically go past the flat portion of the wall 21, thereby creating the expansion unit 30B, which may include an additional cavity for multiple uses.

The expandable enclosure 10 may be collapsed by, for example performing the foregoing steps in reverse order. For example, each wall 21 may be collapsed (or retracted) by applying a collapsing force to the hub 41 so that the wall supports 22 and/or expansion supports 42 are released and collapse with respect to the hub 41 toward the collapsed configuration (shown in FIG. 9). The expansions supports 42 may be collapsed before, after, or concurrently with the collapse of the wall supports 22. The collapsing force may be applied to the hub 41 by, for example, grasping and pulling on the pull 47 (shown in FIG. 11), or pushing on the wall 21 and/or expansion structure 30 inward (i.e., toward the center of the enclosure 20) using a hand, a foot, or a tool.

The terms "including," "comprising," and variations thereof, as used in this disclosure, mean "including, but not limited to," unless expressly specified otherwise.

The terms "a," "an," and "the," as used in this disclosure, means "one or more," unless expressly specified otherwise.

When a single structure or article is described herein, it will be readily apparent that more than one device or article may be used in place of a single device or article. Similarly, where more than one device or article is described herein, it will be readily apparent that a single structure or article may be used in place of the more than one structure or article. The functionality or the features of a structure or article may be alternatively embodied by one or more other structures or articles that are not explicitly described as having such functionality or feature.

While the disclosure has been described in terms of exemplary embodiments, those skilled in the art will recognize that the disclosure can be practiced with modifications in the spirit and scope of the instant disclosure. These examples given above are merely illustrative and are not meant to be an exhaustive list of all possible designs, embodiments, applications or modifications of the disclosure.

What is claimed is:

1. An enclosure system that includes an enclosure having walls and a roof that form a useable space when the walls and roof are deployed and a further deployable expansion structure for added space to the enclosure, the enclosure system comprising:

a cover that includes a panel that forms a wall or the roof of the enclosure;

a plurality of wall supports that connect to the panel, with each of the plurality of wall supports having a first end that connects to a portion of the panel;

an expansion support having a first end and a second end, wherein the first end of the expansion support connects to a portion of the expansion structure; and a hub that connects to a second end of each of the plurality of wall supports and the second end of the expansion support, wherein the expansion support is pivotable from a first position to a second position with respect to the hub to deploy the expansion structure outward and away from the enclosure to form a cavity with space that is additional to said useable space formed by the walls and roof of the enclosure.

2. The enclosure of claim 1, wherein the first position is a substantially collapsed position and the second position is a substantially extended position.

3. The enclosure of claim 1, wherein the hub comprises a main hub and a subhub that are separable from each other.

4. The enclosure of claim 1, wherein the hub comprises a bracket.

5. The enclosure of claim 1, wherein the plurality of wall supports comprises four wall supports.

6. The enclosure of claim 1, wherein the panel comprises a wall or a roof of the enclosure.

7. The enclosure of claim 1, wherein the expansion structure comprises a frame that includes the expansion support.

8. The enclosure of claim 1, further comprising a fastener that connects to the second end of at least one of the plurality of wall supports, wherein the fastener allows said at least one of the plurality of wall supports to pivot with respect to the hub.

9. The enclosure of claim 1, further comprising an adjuster that varies an angle between the hub and the second end of at least one of the plurality of wall supports.

10. The enclosure of claim 1, further comprising a fastener that connects to the second end of expansion support, wherein the fastener allows the expansion support to pivot with respect to the hub.

11. The enclosure of claim 1, wherein the expansion support is pivotable from the first position to the second position with respect to the plurality of wall supports.

12. The enclosure of claim 1, wherein said portion of the cover comprises the panel.

13. An enclosure system that includes an enclosure having walls and a roof that form a useable space when the walls and roof are fully deployed and a further deployable expansion structure for added space to the enclosure, the enclosure system comprising:

a plurality of wall supports that connect to a panel that forms a wall or the roof of the enclosure, with each of the plurality of wall supports having a first end that connects to a portion of the panel;

an expansion support having a first end that forms a portion of the expansion structure; and a hub that connects to a second end of each of the plurality of wall supports and a second end of the expansion support, wherein the expansion support is pivotable from a first position to a second position with respect to the hub to deploy the expansion structure outward and away from the enclosure, thereby forming a cavity with additional useable space that is in addition to said useable space formed by the enclosure.

14. The enclosure of claim 13, wherein the hub comprises a main hub and a subhub that are separable from each other.

15. The enclosure of claim 13, wherein the expansion structure comprises a frame that includes the expansion support.

16. The enclosure of claim 13, further comprising a fastener that connects to the second end of at least one of the plurality of wall supports, wherein the fastener allows said at least one of the plurality of wall supports to pivot with respect to the hub.

17. The enclosure of claim 13, further comprising an adjuster that varies an angle between the hub and the second end of at least one of the plurality of wall supports.

18. The enclosure of claim 13, further comprising a fastener that connects to the second end of expansion support, wherein the fastener allows the expansion support to pivot with respect to the hub.

19. The enclosure of claim 13, wherein the expansion support is pivotable from the first position to the second position with respect to the plurality of wall supports.

20. An enclosure system that includes an enclosure having walls and a roof that form a useable space when the walls and roof are fully deployed and a further deployable expansion structure for added space to the enclosure, the enclosure system comprising:

a plurality of wall supports arranged to connect to a panel that forms a wall or the roof of the enclosure, each having an end arranged to connect to a portion of the panel;

an expansion support having a first end that connects to a portion of the expansion structure and that forms a portion of the expansion structure; and a hub that connects to a second end of the expansion support and said end of each of the plurality of wall supports, wherein the expansion support is pivotable from a first position to a second position with respect to the hub to deploy the expansion structure outward and away from the enclosure, thereby forming a cavity with additional useable space that is in addition to said useable space formed by the enclosure.

* * * * *